United States Patent [19]

Livemore

[11] 3,970,436

[45] July 20, 1976

[54] GAS PRODUCER ARRANGEMENTS

[76] Inventor: Gerald Sydney Victor Livemore, 71, 7th St., Parkmore, Sandton, Transvaal, South Africa

[22] Filed: Aug. 12, 1975

[21] Appl. No.: 603,971

[30] Foreign Application Priority Data

Aug. 20, 1974 South Africa ..... 74/5325

[52] U.S. Cl. ..... 48/76; 48/63; 48/68; 48/78; 122/5

[51] Int. Cl.[2] ..... C10J 3/76; C10J 3/68

[58] Field of Search ..... 48/67, 68, 76, 77, 78, 48/63, 74; 122/5

[56] References Cited

UNITED STATES PATENTS

| | | | |
|---|---|---|---|
| 1,753,847 | 4/1930 | Bellay | 48/67 |
| 1,897,950 | 2/1933 | Battin et al. | 48/67 |

FOREIGN PATENTS OR APPLICATIONS

| | | | |
|---|---|---|---|
| 13,764 | 6/1903 | United Kingdom | 48/63 |
| 775,157 | 5/1957 | United Kingdom | 48/67 |
| 284,639 | 3/1928 | United Kingdom | 48/67 |

*Primary Examiner*—Robert L. Lindsay, Jr.
*Assistant Examiner*—George C. Yeung
*Attorney, Agent, or Firm*—Lane, Aitken, Dunner & Ziems

[57] ABSTRACT

A steam generating system for a gas producer of the type including a combustion chamber and an annular water jacket surrounding the chamber is disclosed characterised in that the upper part of the jacket is of larger diameter than the lower part thereof, the lower part being heated through substantially direct contact with the combustion chamber and the upper part being insulated from the chamber preferably by means of a skin of fire bricks or the like; an open upwardly directed vent pipe communicating with the lower part of the jacket; and a steam exhaust line communicating with the upper part of the jacket. The system also includes a venturi arrangement for introducing the generated steam to the air blast as well as a safety valve in the steam line which is adapted to respond to temperature changes in the air blast.

2 Claims, 1 Drawing Figure

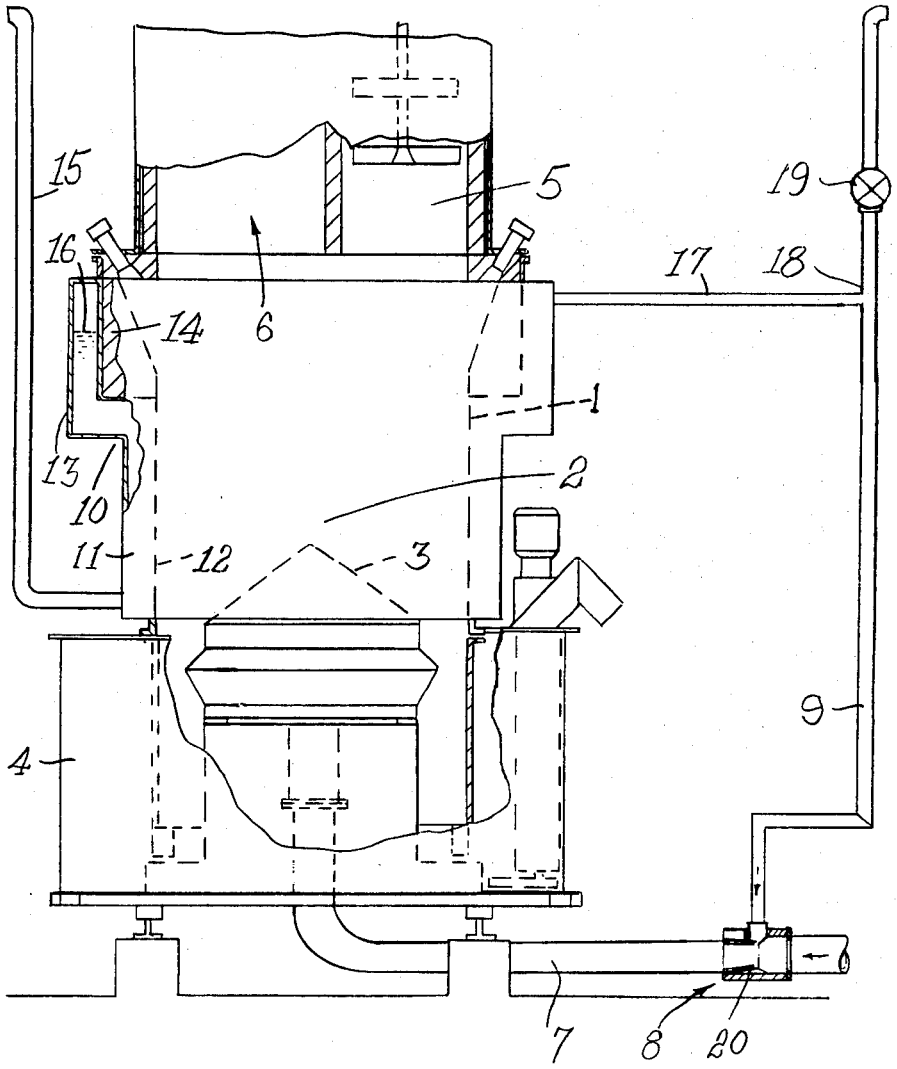
15
16
14
6
5
19
17
18
1
13
10
2
11
12
3
9
4
7
8
20

GAS PRODUCER ARRANGEMENTS

This invention relates to gas producing arrangements and more particularly to the steam generation for air blast saturation in the production of industrial producer gas in such gas producing arrangements.

With conventional gas producers steam is introduced into the fire zone via an air blast to minimise the formation of clinker and to promote the conversion of $CO_2$ to CO.

The raising of this steam is frequently effected by means of a water jacket in or adjacent the fire zone which uses heat generated in the zone to generate the steam in the jacket. A steam release drum is situated above the jacket and interconnecting pipes set up the necessary circulation between the jacket and the drum. Steam from the drum is then fed into the air blast for transmission in regulated fashion to the interior of the producer. This method of steam generation has in the past been classified as a non-pressurised installation not subject to prescribed boiler inspections. However, this situation has changed to the extent that plants of this nature are now subject to inspections with consequent shut downs which could amount to three weeks per year.

To qualify as a non-pressurised installation under the present legal requirements an open vent pipe has to run from the lowest point of the water jacket and discharge at a height not exceeding 4,000 millimeters above the bottom of the water jacket. However, the generating pressure plus the static height required would not permit the use of this open vent on conventional steam generating plants so that even systems of this nature are now treated as pressurised and subject to annual boiler inspections.

As a general rule most gas producers are utilised in conjunction with a plant which is operated continuously and a shut down of two to three weeks per year for boiler inspections is a serious problem.

An object of the present invention is to provide a steam generating system which may be operated successfully with the 4,000 mm open vent requirement and which would thus obviate the shut down problem set out above.

According to the present invention a steam generating system for a gas producer of the type including a combustion chamber and an annular water jacket surrounding the chamber is provided characterised in that the upper part of the jacket is of larger diameter than the lower part thereof, the lower part being heated through substantially direct contact with the combustion chamber and the upper part being insulated from the chamber; an open upwardly directed vent pipe communicating with the lower part of the jacket; and a steam exhaust line communicating with the upper part of the jacket.

Preferably the upper part of the jacket is insulated from the combustion chamber by means of a skin of fire bricks or the like. Further according to the invention the exhaust line feeds steam into an air blast for onward transmission with the blast to the base of the grate in the combustion chamber of the producer, the air blast conduit immediately ahead of the steam entry defining a venturi throat.

The purpose of the venturi arrangement is to minimise the build up of back pressure in the steam exhaust line.

Also according to the invention the steam exhaust line includes a safety valve adapted to respond to temperature changes in the air blast conduit on the downstream end of the steam entry point.

The invention will now be described by way of example with reference to the accompanying drawing which is a diagrammatic representation of one embodiment of a gas producer partly in section which employs the steam generating concept of the invention.

Referring to the drawing the gas producer includes a combustion chamber 1 defining a fire zone 2 above a rotating grate 3 enclosed by a water seal 4. Coal enters the fire zone 2 via feed chute 5 and gas produced in the device rises towards top and bottom gas off-takes in the direction of arrow 6. To promote production of gas from the coal fuel an air blast enters the fire zone from beneath the grate 3 with steam entrapped therein. The air blast is directed along air blast conduit 7 with steam entering conduit 7 via steam line 9 at point 8 in an arrangement which will be discussed further at a later stage.

The equipment thus far described is not of the essence of the invention but serves to provide a basis for introducing the principal features of the invention.

Production of steam via available heat energy in the gas producer is achieved by means of annular water jacket 10 which surrounds combustion chamber 1 of the gas producer. Water jacket 10 has a lower annular part 11, which is separated from fire zone 2 by metal wall 12 of chamber 1 and an upper annular part $\beta$ which is of larger diameter and which is separated from chamber 1 by an annular insulation lining of fire bricks 14. An open vent pipe 15 communicates with the lower zone 11 of water jacket 10, the length of the pipe being selected according to requirements.

The water level in the jacket is indicated by reference number 16 and the steam above this level is drawn off via steam exhaust pipe 17. Pipe 17 is connected to steam line 9 and above the junction 18 a safety valve 19 is incorporated. Valve 19 is adapted to respond to temperature conditions in conduit 7 on the downstream end of the junction point 8.

To prevent build up of back pressure in the steam line 9 and hence in the jacket itself a venturi throat 20 is provided as shown in conduit 7.

The advantages of the arrangement of the invention lie in several directions. The absence of any steam drum is apparent and in consequence inter- connecting pipe work is avoided. Steam generated in water jacket 10 is released directly into the steam space immediately above the water level and this is clearly an improvement over those systems in which the water jacket is linked to a steam drum. Also, the relatively large surface area of the water below the steam space permits the release of steam at low pressures without foaming or priming.

Furthermore, pipework from the steam space to the undergrate air blast may be directly connected to the air blast without the need for the inclusion of any regulating or isolating valves. The steam pressure generated is, therefore, restricted to the pressure required to overcome the air pressure within the air blast itself. The pressure is further reduced by introducing steam into the throat of a venturi arrangement 20.

Also, excess steam is conveniently discharged to atmosphere via the automatic control valve operated by the temperature of the air blast.

It will also be appreciated that the generation of fully saturated steam at very low pressures results in all sizes of producers being capable of supplying sufficient steam to satisfy the air blast requirements. This has not always been possible with previous systems where it has often been necessary to provide make-up steam from an external source to achieve the correct air blast temperature.

Most important, however, is the fact that the steam generator concept of the arrangement according to the invention qualifies for classification as a non-pressurised installation and hence obviates the problems set out in the introductory part of the specification.

It will be appreciated that with a steam generating system according to the invention many variations in detail are possible without departing from the scope of the appended claims.

I claim:

1. In a steam generating system for gas producers of the type including a combustion chamber having a grate for the introduction of an air blast with steam entrapped therein and an annular water jacket surrounding the combustion chamber, the improvement comprising:

an open inwardly directed vent pipe communicating with the lower part of the water jacket;

a steam exhaust line communicating at one end with the upper part of the jacket;

an air blast conduit opening to the grate in the combustion chamber, said exhaust line being connected at its other end to a juncture with said conduit for entry and transmission of steam with the air blast to the grate, the air blast conduit immediately downstream from said juncture of said conduit with said exhaust line defining a venturi throat; and a safety valve in said exhaust line adapted to respond to temperature changes in the air blast conduit at said juncture.

2. The apparatus recited in claim 1 wherein the upper part of the annular water jacket is of a larger diameter than the lower part thereof, the lower part being heated by substantially direct contact with the combustion chamber and the upper part being insulated from the chamber.

* * * * *

UNITED STATES PATENT AND TRADEMARK OFFICE

CERTIFICATE OF CORRECTION

PATENT NO. : 3,970,436

DATED : July 20, 1976

INVENTOR(S) : Gerald Sydney Victor Livemore

It is certified that error appears in the above-identified patent and that said Letters Patent are hereby corrected as shown below:

Column 4, line 3, delete "inwardly" and substitute therefor --upwardly--.

Signed and Sealed this

Twenty-second Day of February 1977

[SEAL]

*Attest:*

RUTH C. MASON
*Attesting Officer*

C. MARSHALL DANN
*Commissioner of Patents and Trademarks*